United States Patent [19]

Blanchard et al.

[11] 4,236,890

[45] Dec. 2, 1980

[54] PROCESS FOR PRODUCING TRANSFER PRINTED COTTON AND COTTON BLENDS

[75] Inventors: Eugene J. Blanchard, New Orleans; Gloria A. Gautreaux; Robert J. Harper, Jr., both of Metairie, all of La.

[73] Assignee: The United States of America as represented by the Secretary of Agriculture, Washington, D.C.

[21] Appl. No.: 913,418

[22] Filed: Jun. 7, 1978

[51] Int. Cl.[3] ..... D06P 1/16; D06P 1/58; D06P 3/60; D06P 3/84

[52] U.S. Cl. ..... 8/410; 8/17; 8/2.5 R

[58] Field of Search ..... 8/17, 2.5 R, 2.5 A

[56] References Cited

U.S. PATENT DOCUMENTS

| | | | |
|---|---|---|---|
| 3,948,600 | 4/1976 | Reinhardt et al. | 8/183 |
| 4,063,809 | 12/1977 | Faulhaber et al. | 8/2.5 R |
| 4,072,462 | 2/1978 | Vellins et al. | 8/2.5 A |
| 4,088,440 | 5/1978 | Leimbacher et al. | 8/2.5 R |

FOREIGN PATENT DOCUMENTS

| | | | |
|---|---|---|---|
| 2754653 | 6/1979 | Fed. Rep. of Germany | 8/2 .5 A |
| 2309665 | 11/1976 | France | 8/2.5 A |
| 2315524 | 1/1977 | France | 8/17 |
| 1243223 | 8/1971 | United Kingdom | 8/25 A |
| 1403119 | 8/1975 | United Kingdom | 8/2.5 A |
| 1445201 | 8/1976 | United Kingdom | 8/2.5 A |

OTHER PUBLICATIONS

Wild, K. Jour. Soc. of Dyers & Colorists, May 1977, pp. 185–188.

*Primary Examiner*—Joseph L. Schofer
*Assistant Examiner*—Maria S. Tungol
*Attorney, Agent, or Firm*—M. Howard Silverstein; David G. McConnell; Raymond C. Von Bodungen

[57] ABSTRACT

A pretreatment system composed of hexamethoxymethyl melamine, p-toluene sulfonic acid, 2-amino-2-methyl-1-propanol, triethylamine, butoxy triglycol, and carboxy vinyl polymeric thickener is disclosed, which through application to the fabric surface by a screen printing technique is highly effective in improving the affinity of cellulose-containing textiles for disperse dyestuffs. Fabrics with prints that are durable to washing are produced by simultaneously heat transfer printing and curing at about 190° C. to 220° C. for 20–30 seconds.

3 Claims, No Drawings

PROCESS FOR PRODUCING TRANSFER PRINTED COTTON AND COTTON BLENDS

BACKGROUND OF THE INVENTION (1) Field of the Invention

This invention relates to the heat transfer printing of fabrics with disperse dyes. More specifically it relates to a pretreatment, crosslinking system that is useful in the screen printing of cellulose-containing textile materials to improve the affinity of such textiles for disperse dyestuffs. The method allows the pretreatment to be applied to a textile in fabricated garment form.

(2) Description of the Prior Art

Heat transfer printing is a process whereby a paper containing disperse dyestuffs on the surface is placed in contact with a suitable material and heated, so that the sublimable dyes are transferred from paper to fabric. Unmodified cellulose cannot be effectively heat transfer printed with disperse dyes because of a lack of affinity. Very little dye is adsorbed by the cellulose, and this small amount is removed upon washing. This is in marked contrast to the effect obtained with some synthetic textiles, such as polyester, which have excellent affinity for disperse dyes.

Lambert, British Pat. No. 1,445,201, has demonstrated that the affinity of a cellulose-containing textile for disperse dyes can be improved by treatment with a methylated melamine-formaldehyde resin in which there are five—$CH_2OCH_3$ groups per melamine group. The fabric is printed by heating for 3 minutes at 200°-210° C. with transfer paper containing disperse dyes. This longer printing time is needed because of the use of a weaker catalyst, such as $(NH_4)H_2PO_4$, than is usually used for resin finishing of cellulose.

British Pat. No. 1,460,742 teaches that cellulose-containing fabrics can be effectively transfer printed with disperse dyestuffs if the fabric is impregnated with at least one curable resin containing one or more hydroxymethyl, alkoxymethyl or aldehyde groups that are capable of reacting with the disperse dyestuffs. The recommended disperse dyestuffs contain one or more amino, hydroxy, or N-hydroxyalkylamino groups.

In all prior work, no system composed of hexamethoxymethyl melamine, p-toluene sulfonic acid, 2-amino-2-methyl-1-propanol, triethylamine, butoxy, triglycol, and carboxy vinyl polymeric thickener has been employed as a pretreatment for fabric by screen printing the formulation onto the surface of a cellulose-containing garment so as to increase its disperse dye affinity.

Those systems with methylated melamine-formaldehyde resin and other components all teach that the fabric is to be treated by padding with a low viscosity formulation.

SUMMARY OF THE INVENTION

This invention provides a screen printable pretreatment system for cellulose-containing fabrics to improve their affinity for disperse dyes upon heat transfer printing. The pretreatment system is composed of hexamethoxymethyl melamine, p-toluene sulfonic acid, 2-amino-2-methyl-1-propanol, triethylamine, butoxy triglycol, and carboxy vinyl polymeric thickening agent. It is the object of this invention to produce heat transfer printable cotton and cotton blend fabrics with good durability of the print to washing.

It is a further object to provide a method to transfer print a specific area of a cellulose-containing garment.

A still further object is to provide a pretreatment system that will allow the treated fabric to be dried at temperatures without premature curing.

DESCRIPTION OF THE PREFERRED EMBODIMENTS

We have found that a pretreatment system consisting of hexamethoxymethyl melamine, p-toluene sulfonic acid, 2-amino-2-methyl-1-propanol, triethylamine, butoxy triglycol, and carboxy vinyl thickener is highly effective in one-sided treatments for producing transfer-printable cotton and cotton-polyester fabrics.

The pretreatment system of the present invention offers the textile screen printer the opportunity to heat transfer print cotton-containing fabrics with disperse dyestuffs in a dry process instead of printing with pigment dyes in a wet process. Inventory control is greatly facilitated because print designs are stored on inexpensive papers instead of more expensive fabric.

The pretreatment system is composed of hexamethoxymethyl melamine that may be used from about 5 g to about 20 g for each 100 g of printing formulation or from 5% to 20%, by weight, of the treatment formulation. Concentrations of p-toluene sulfonic acid should be from about 0.05% to about 0.2%. The concentration of the 2-amino-2-methyl-1-propanol should be from about 0.05% to about 0.2%. The concentration of triethylamine should be about 0.5%. Concentrations of the butoxy triglycol should be from about 1.25% to about 5%. The concentrations of the vinyl carboxy thickener should be about 0.5%, and that of isopropanol from about 3.75% to about 15%.

Temperatures to achieve drying after screen printing the formulation onto the fabric range from about 25° C. to 150° C. Drying times may be from 1 minute to 30 minutes; the preferred drying conditions for minimum drying time are 1.5 minutes at 150° C.

The following examples further describe the invention. They are given as illustrations and thus should not be considered as limiting the scope of the invention.

EXAMPLE 1

A thickened solution was prepared such that in each 100 g there were 5 g hexamethoxymethyl melamine, 0.05 g p-toluene sulfonic acid, 0.5 g triethylamine, 0.05 g 2-amino-2-methyl-1-propanol, 1.25 g butoxy triglycol, 0.5 g carboxy vinyl thickener, 3.75 g 2-propanol, and 88.9 g water.

Both 50/50 cotton-polyester and 100% cotton interlock fabrics weighing approximately 5.2 oz/sq. yd. were used for treatments. Samples were treated on one side with the thickened solution containing hexamethoxymethyl melamine crosslinking agent by screen printing the fabric through a10XX mesh screen. After printing, the fabric was dried for 5 minutes at 100° C. The add-on was about 4.9%.

The samples were transfer printed with transfer printing paper containing disperse dye on a heat transfer machine with a 15×15 inch platen. Printing conditions were 204° C. for 30 seconds. Reflectance measurements of the samples that were printed with a transfer printing paper containing a black dyestuff formulation are shown in Table I.

TABLE I

| Sample | Photovolt Reflectance Initial | Photovolt Reflectance 5 washings | Coloration Initial |
|---|---|---|---|
| 100% Cotton | 5.0 | 9.0 | Deep |
| 100% Cotton Control | 14.1 | 32.7 | Light |
| 50/50 C/PE | 5.8 | 6.3 | Deep |
| 50/50 C/PE Control | 12.0 | 14.2 | Dull |

These results demonstrate that the affinity of cellulose-containing fabrics is significantly increased by pretreating the fabrics with the thickened solution containing 5% hexamethoxymethyl melamine, and that durability of the prints to washing is good.

EXAMPLE 2

A thickened solution was prepared such that in each 100 g there were 10 g hexamethoxymethyl melamine, 0.2 g p-toluene sulfonic acid, 0.5 g triethylamine, 0.1 g 2-amino-2-methyl-1-propanol, 2.5 g butoxy triglycol, 7.5 g 2-propanol, 78.65 g water, and 0.5 g carboxy vinyl thickener. After printing the fabrics as in Example I, the fabrics were dried for 5 minutes at 100° C. The add-on was about 7%.

The same procedure for transfer printing the samples as in Example I was used. Reflectance measurements of the samples that were printed with a black dyestuff formulation are shown in Table II.

TABLE II

| Sample | Photovolt Reflectance Initial | Photovolt Reflectance 5 washings | Coloration Initial |
|---|---|---|---|
| 100% Cotton | 5.0 | 8.2 | Deep |
| 100% Cotton Control | 14.1 | 32.7 | Light |
| 50/50 C/PE | 5.1 | 6.5 | Deep |
| 50/50 C/PE Control | 12.0 | 14.2 | Dull |

These results demonstrate that the affinity of cellulose-containing fabrics is significantly increased by pretreating the fabrics with the thickened solution containing 10 percent hexamethoxymethyl melamine.

EXAMPLE 3

A thickened solution was prepared such that in each 100 g there were 20 g hexamethoxymethyl melamine, 0.2 g p-toluene sulfonic acid, 0.5 g triethylamine, 0.2 g 2-amino-2-methyl-1-propanol, 5 g butoxy triglycol, 15 g 2-propanol, 58.3 g water, and 0.5 g carboxy vinyl thickener. After printing the fabrics as in Example I, the fabrics were dried for 5 minutes at 100° C. The add-on was about 17.3%.

The same procedure for transfer printing the samples as in Example I was used. Reflectance measurements of the samples that were printed with transfer printing paper containing a black dyestuff formulation are shown in Table III.

TABLE III

| Sample | Photovolt Reflectance Initial | Photovolt Reflectance 5 washings | Coloration Initial |
|---|---|---|---|
| 100% Cotton | 5.0 | 7.8 | Deep |
| 100% Cotton Control | 14.1 | 32.7 | Light |
| 50/50 C/PE | 4.8 | 6.4 | Deep |
| 50/50 C/PE Control | 12.0 | 14.2 | Dull |

The results demonstrate that the affinity of cellulose-containing fabrics is significantly increased by pretreating the fabrics with the thickened solution containing 20 percent hexamethoxymethyl melamine.

EXAMPLE 4

A thickened solution was prepared such that in each 100 g there were 12 g hexamethoxymethyl melamine, 0.12 g p-toluene sulfonic acid, 0.12 g 2-amino-2-methyl-1-propanol, 0.5 g triethylamine, 3 g butoxy triglycol, 0.5 g carboxy vinyl thickener, 9 g 2-propanol, and 74.58 g water.

Both a 50/50 cotton-polyester and a 100% cotton plain jersey knit shirt were used for treatments. The garments were treated on the front side by screen printing with the solution through a 20 mesh screen. Only one side of the garments was treated. The garments were dried for 1.5 minutes at 150° C. The knit shirts were then heat transfer printed with transfer printing paper containing disperse dyestuffs for 30 seconds at 190° C. The resulting knit shirts had prints with bright deep colors in contrast to the dull and light colors on the untreated control shirts. After 10 washings, the treated shirts had very good color retention for the 50/50 cotton-polyester and fair color retention for the 100% cotton. This was in contrast to the unacceptable appearance of the untreated control shirts.

These results demonstrate that 100% cotton and especially 50/50 cotton-polyester knit shirts can be readily treated with the designated formulation by means of a screen printing technique to substantially increase the affinity of the cellulose-containing garment for disperse dyestuffs. Further, it is demonstrated that through the use of screen printing techniques any specified area of the fabric can be treated after the fabric has been converted into garment form.

EXAMPLE 5

The same procedure as employed in Example 4 was used except the treated shirts were dried at 25° C. for 30 minutes by means of forced air.

We claim:

1. A process for improving the affinity of cellulose-containing fabrics for disperse dyestuffs, the process comprising (a) screen printing a textile in the desired area with a formulation consisting of
  (1) about 5–20%, by weight, of hexamethoxymethyl melamine crosslinking agent,
  (2) about from 0.05% to 0.2%, by weight, of p-toluene sulfonic acid,
  (3) about from 0.05% to 0.2% of 2-amino-2-methyl-1-propanol,
  (4) about 0.5% of triethylamine
  (5) about from 1.25% to 5% of butoxy triglycol and
  (6) about 0.5% of carboxy vinyl polymeric thickener, (b) drying the fabric, which is wet on the surface only, (c) heat transfer printing the fabric with paper that contains disperse dyestuffs.

2. The process of claim 1 wherein the fabric is in garment form.

3. The process of claim 1 wherein the garment is dried from about 25° C. to 150° C. for about from 30 minutes to 1.5 minutes.

* * * * *